US009103607B2

(12) United States Patent
Furberg et al.

(10) Patent No.: US 9,103,607 B2
(45) Date of Patent: Aug. 11, 2015

(54) POROUS LAYER

(75) Inventors: Richard Furberg, Solna (SE); Björn Palm, Huddinge (SE); Shanghua Li, Solna (SE); Mamoun Muhammed, Djursholm (SE); Muhammet Toprak, Goleta, CA (US)

(73) Assignee: MICRO DELTA T AB, Akersberga (SE)

( * ) Notice: Subject to any disclaimer, the term of this patent is extended or adjusted under 35 U.S.C. 154(b) by 1401 days.

(21) Appl. No.: 12/224,707

(22) PCT Filed: Mar. 2, 2007

(86) PCT No.: PCT/SE2007/000208

§ 371 (c)(1),
(2), (4) Date: Oct. 28, 2009

(87) PCT Pub. No.: WO2007/100297

PCT Pub. Date: Sep. 7, 2007

(65) Prior Publication Data

US 2010/0044018 A1 Feb. 25, 2010

(30) Foreign Application Priority Data

Mar. 3, 2006 (SE) ..... 0600475

(51) Int. Cl.
*F28F 13/18* (2006.01)
*F28F 19/02* (2006.01)
(Continued)

(52) U.S. Cl.
CPC ..... *F28F 13/187* (2013.01); *C25D 5/003* (2013.01); *C25D 5/16* (2013.01); *C25D 5/50* (2013.01);
(Continued)

(58) Field of Classification Search
CPC ..... C25D 5/16; C25D 5/003; C25D 5/50; C25D 7/00; F28F 13/18; F28F 13/003; F28F 13/182; F28F 13/185; F28F 13/187; F28F 21/089; F28F 2255/20; F28D 17/02; F28D 15/046; B22F 7/002
USPC ..... 165/133, 146, 911; 428/613; 205/111, 205/112; 427/248.1
See application file for complete search history.

(56) References Cited

U.S. PATENT DOCUMENTS 3,152,774 A * 10/1964 Wyatt ..... 244/171.7
3,298,936 A * 1/1967 Michael ..... 205/180
(Continued)

FOREIGN PATENT DOCUMENTS

EP 0224761 A1 6/1987
EP 0226861 A1 7/1987
(Continued)

OTHER PUBLICATIONS

Shin et al., "Nanoporous Structures Prepared by an Electrochemical Deposition Process," Adv. Mater. 2003, 15, No. 19, Oct. 2, pp. 1610-1614.*
(Continued)

*Primary Examiner* — Frantz Jules
*Assistant Examiner* — Joseph Trpisovsky
(74) *Attorney, Agent, or Firm* — The Marbury Law Law Group PLLC

(57) ABSTRACT

Heat exchange device with a boiling surface comprising a porous surface layer arranged on a solid substrate, the porous surface layer comprises a porous wall structure defining and separating macro-pores that are interconnected in the general direction normal to the surface of the substrate and have a diameter greater than 5 μm and less than 1000 μm wherein the diameter of the pores gradually increases with distance from the substrate wherein the porous wall structure is a continuous branched structure.

6 Claims, 17 Drawing Sheets

(51) Int. Cl.

| | |
|---|---|
| ***F28F 13/00*** | (2006.01) |
| ***B32B 5/18*** | (2006.01) |
| ***C25D 5/00*** | (2006.01) |
| ***C25D 5/16*** | (2006.01) |
| ***C25D 5/50*** | (2006.01) |
| ***C25D 7/00*** | (2006.01) |

(52) U.S. Cl.
CPC ..... *C25D 7/00* (2013.01); *F28F 2255/20* (2013.01); *Y10T 428/12479* (2015.01); *Y10T 428/26* (2015.01)

(56) References Cited

U.S. PATENT DOCUMENTS

| | | | | | |
|---|---|---|---|---|---|
| 3,384,154 | A | | 5/1968 | Milton | |
| 3,523,577 | A | | 8/1970 | Milton | |
| 3,587,730 | A | | 6/1971 | Milton | |
| 3,884,772 | A | | 5/1975 | Shiga | |
| 4,120,994 | A | * | 10/1978 | Inoue | 427/239 |
| 4,216,826 | A | | 8/1980 | Fujikake | |
| 4,258,783 | A | | 3/1981 | Albertson et al. | |
| 4,381,818 | A | | 5/1983 | Sachar et al. | |
| 4,780,373 | A | | 10/1988 | Masuda et al. | |
| 4,826,578 | A | * | 5/1989 | Masuda et al. | 205/104 |
| 5,882,723 | A | * | 3/1999 | Tsou | 427/125 |
| 6,082,444 | A | * | 7/2000 | Harada et al. | 165/133 |
| 7,360,581 | B2 | * | 4/2008 | Tuma et al. | 165/80.3 |
| 2004/0137209 | A1 | * | 7/2004 | Zeller et al. | 428/304.4 |
| 2004/0256236 | A1 | * | 12/2004 | Minevski et al. | 205/109 |
| 2005/0022976 | A1 | * | 2/2005 | Rosenfeld et al. | 165/104.11 |

FOREIGN PATENT DOCUMENTS

| | | | |
|---|---|---|---|
| JP | 2002-228389 | A | 8/2002 |
| WO | WO 02/38827 | A1 | 5/2002 |

OTHER PUBLICATIONS

PCT/SE2007/000208, International Search Report, Jun. 20, 2007.
Donchenko et al., "Role of Surface-Active Additives at Obtaining of Highly-Porous Coatings", Gal 'vanotechnika i obrabotka poverchnosti, 1996, pp. 18-22, 4(3).
Schultz, "Mikrostrukturierte Wärmetauscherrohre", Kl Luft- und Kältetechnik, Jun. 2004, pp. 218-221, 40(6).
PCT/SE2007/000208, International Preliminary Report on Patentability, Sep. 9, 2008.
Shin et al., "Nanoporous Structures Prepared by an Electrochemical Deposition Process," Adv. Mater. 2003, 15, No. 19, Oct. 2.
Li et al., "Nanostructured Surfaces for Boiling Enhancement," Symposium R, Nanoporous and Nanostructured Materials for Catalysts, Sensor, and Gas Separation Applications, Mar. 28-Apr. 1, 2005, p. 419.
Extended European Search Report, EP Application No. 07709401, dated Sep. 13, 2013, 9pgs.

* cited by examiner

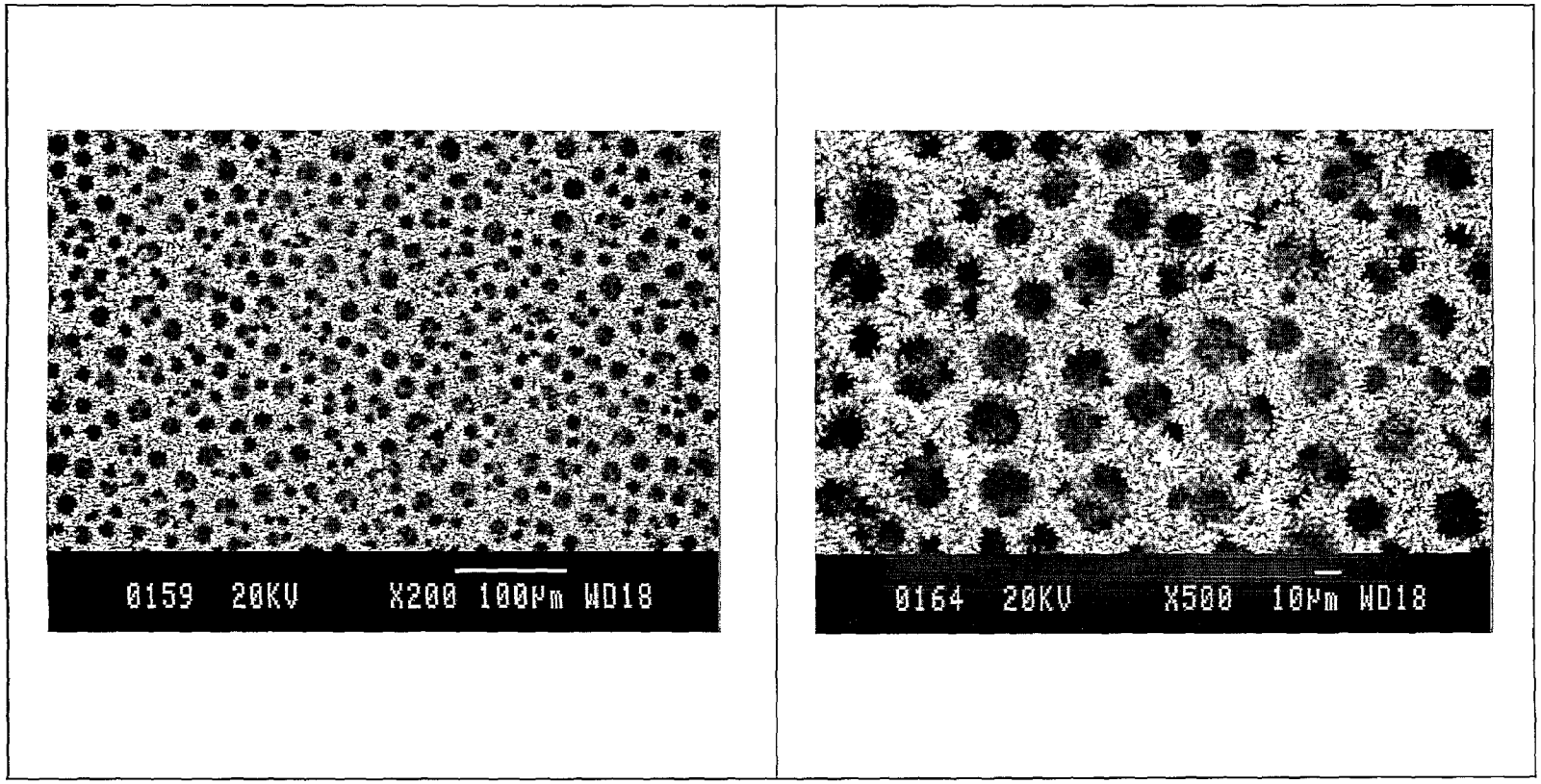
PRIOR ART
Fig. 1 (1)

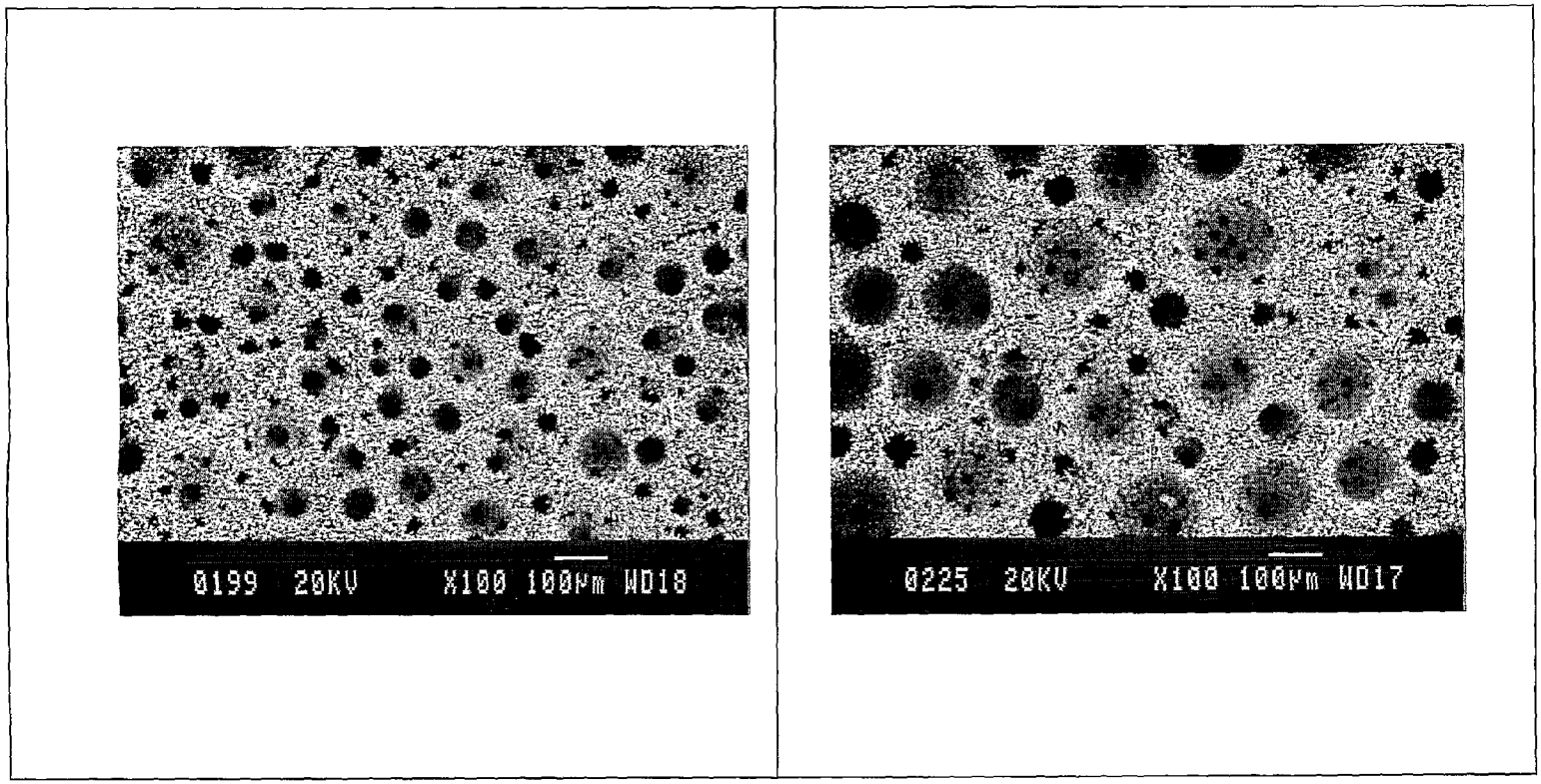
PRIOR ART
Fig. 1 (2)

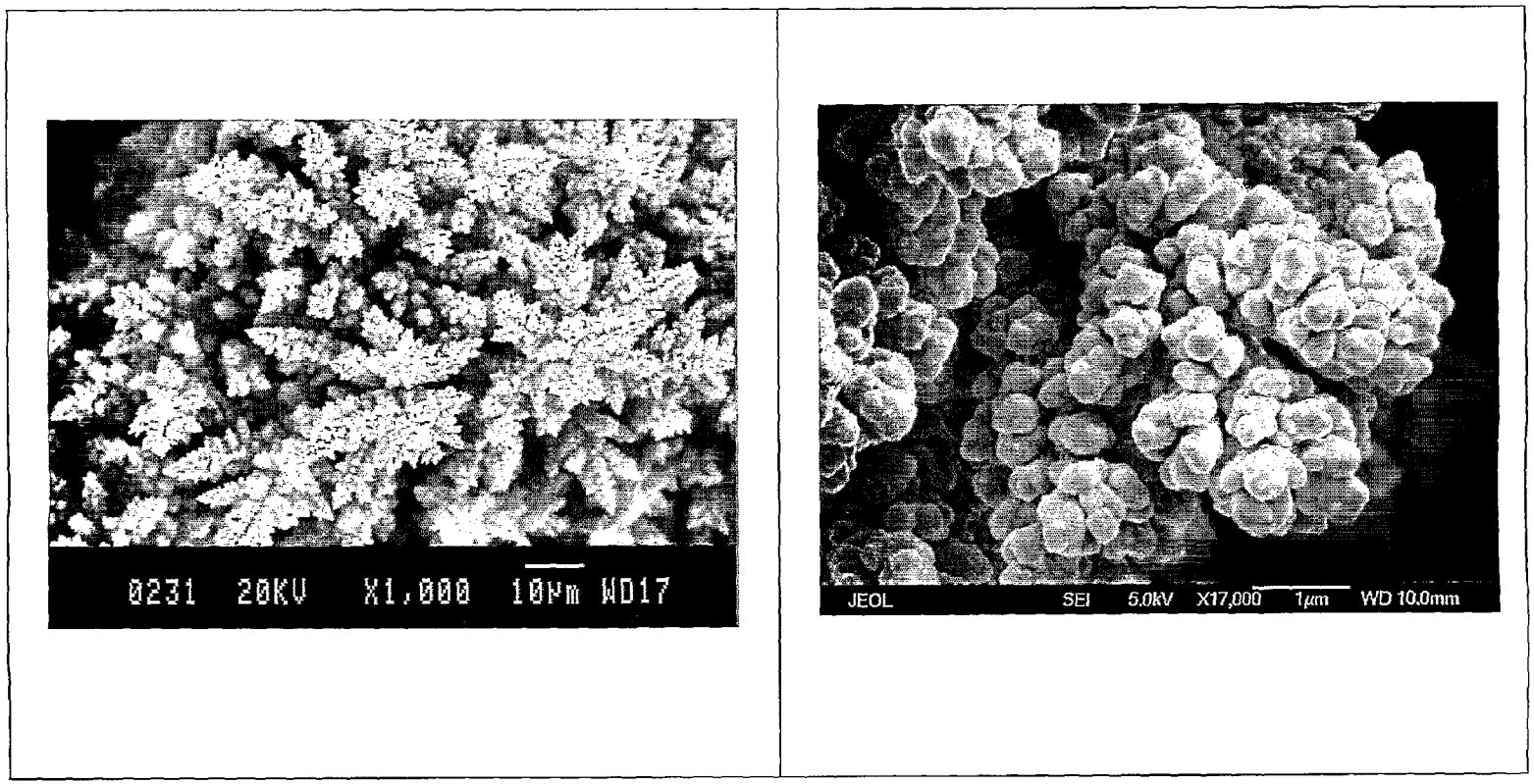
PRIOR ART
Fig. 1 (3)

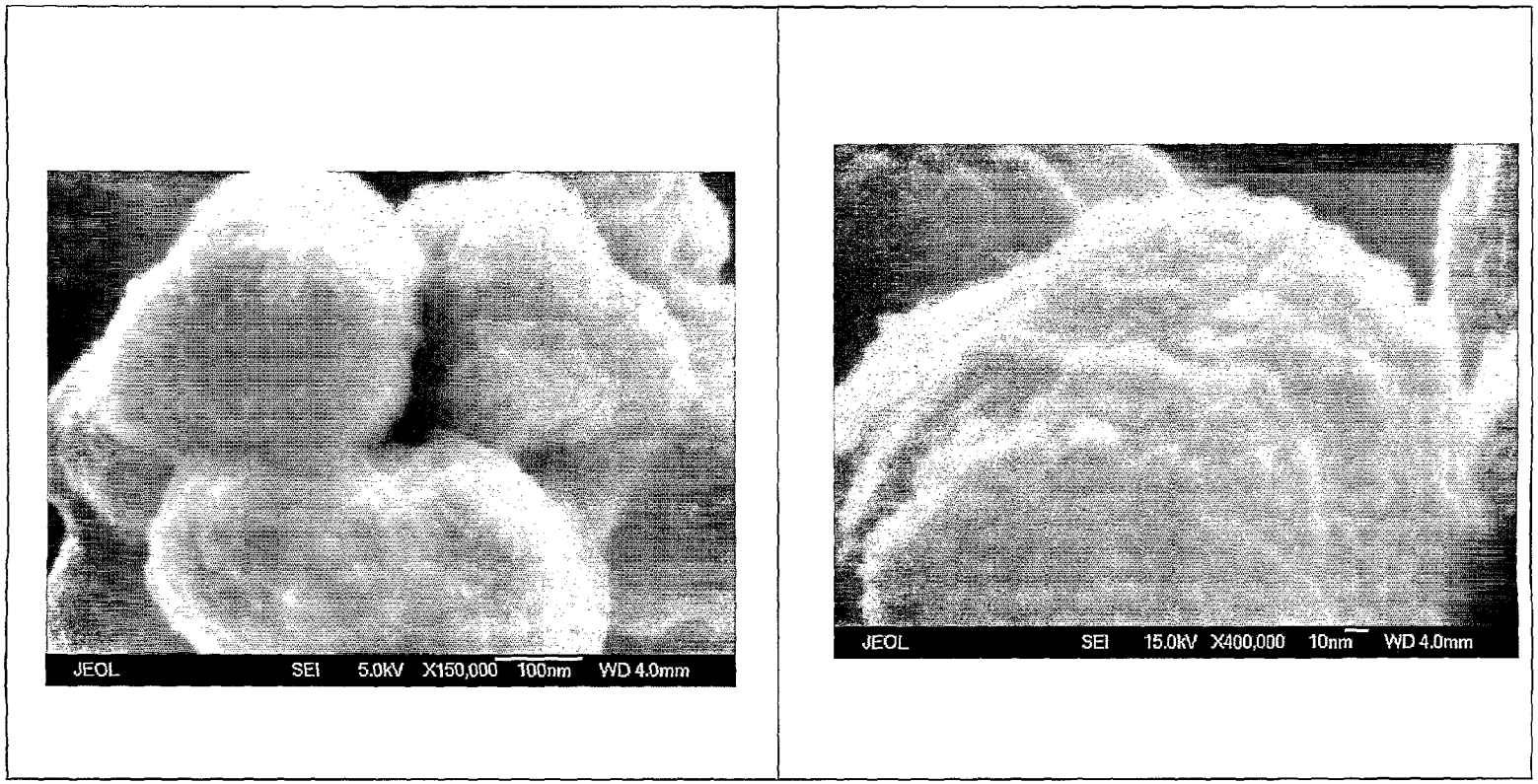
PRIOR ART
Fig. 1 (4)

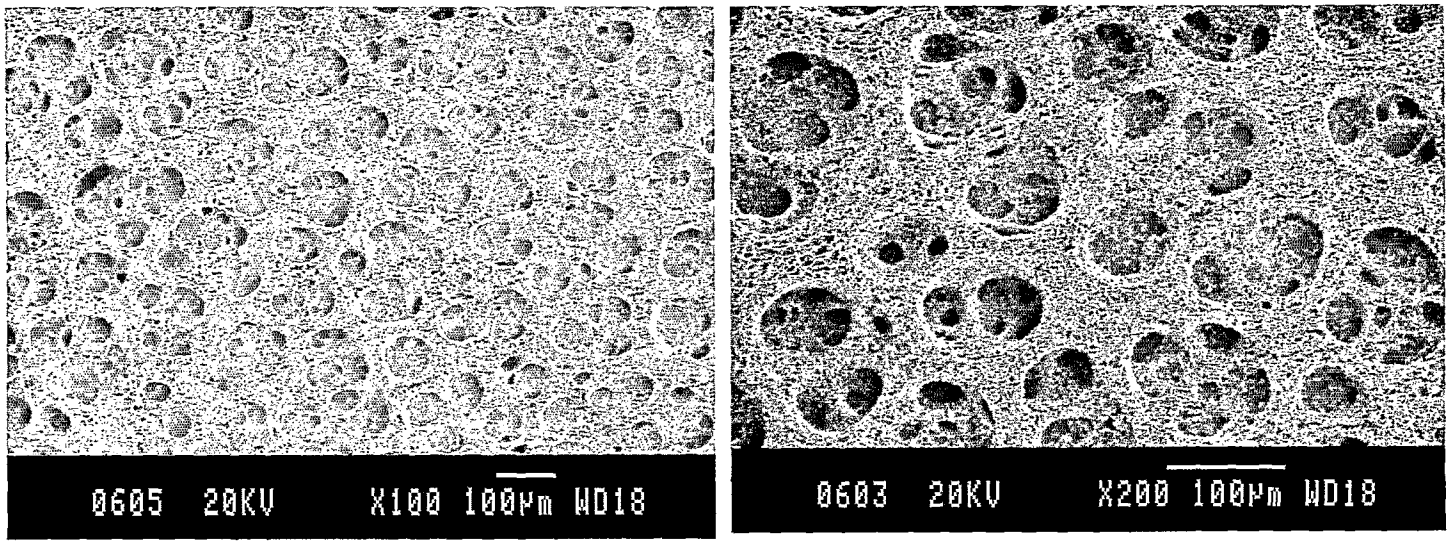
Fig. 2 (1)

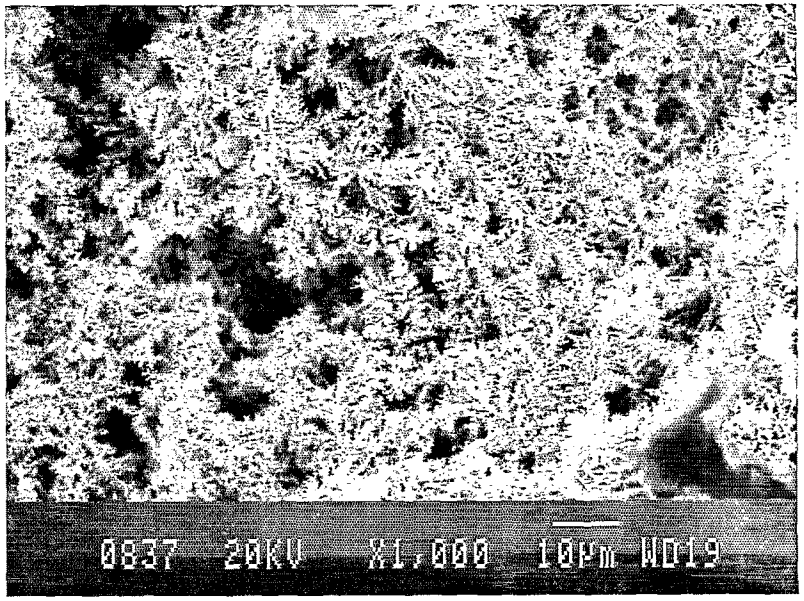
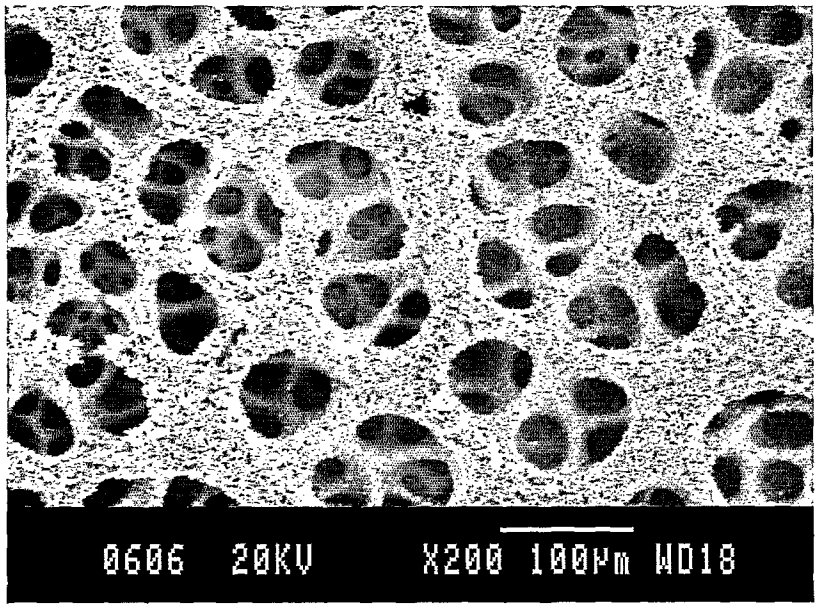
Fig. 2 (2)

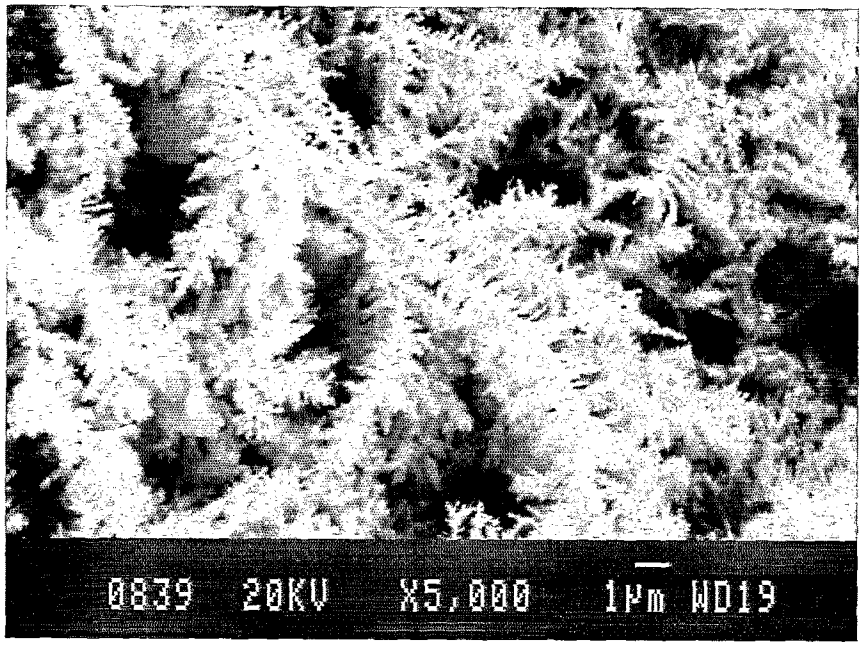
Fig. 2 (3)

POROUS LAYER

CROSS REFERENCE TO RELATED APPLICATIONS

This application is a National Stage patent application filed under 35 U.S.C. §371 of International Patent Application No. PCT/SE2007/000208, filed Mar. 2, 2007, which designated the United States of America, and which claims priority to Sweden Patent Application No. 0600475-8, filed Mar. 3, 2006. The disclosure of each of the above-identified related applications is hereby fully incorporated herein by reference.

TECHNICAL FIELD

The present invention is directed to a porous layer, a heat exchanger device with a boiling surface with a porous surface layer arranged on a solid substrate, and a method for forming a porous surface layer on a substrate.

BACKGROUND OF THE INVENTION

The present invention relates to developing new high-efficiency evaporators.

In refrigeration equipment, air conditioning equipment and heat pumps, commonly named heat pumping equipment, it is very important to operate with small temperature differences between the heat source, e.g. air or water, and the boiling refrigerant in the evaporator. These small temperature differences contribute to decrease the difference between the condensation temperature and the evaporation temperature which is very important to achieve high energy efficiency of the system, usually expressed in terms of the coefficient of performance (COP) defined as, for heating purposes, the amount of heat (q1) delivered to the warm side divided by the amount of work (ϵ) required for the compression of the refrigerant vapor (COP1=q1/ϵ), and for refrigeration purposes as the amount of heat (q2) absorbed from the cold side divided by the amount of work (ϵ) required for the compression of the refrigerant vapor (COP2=q2/ϵ).

The heat transfer rate in evaporators is governed by the equation $Q=h\cdot A\cdot \Delta T$, where h is the heat transfer coefficient (HTC), A is an area relating to the heat transfer surface and ΔT is the temperature difference between the surface and the bulk fluid. To achieve low temperature differences, a high HTC or a large heat transfer surface area is needed. Thus, to reduce the temperature difference in the evaporator of heat pumping equipment some type of enhanced surface can be used which can promote bubble nucleation and thereby increase the HTC of the evaporator.

The enhancement could also be a mean to reduce the necessary size of the evaporator, without increased temperature difference, for miniaturization purposes (smaller, more space efficient and economical evaporators). Enhanced surfaces not only increase the heat transfer coefficient but may also increase the critical heat flux (CHF) and decrease the temperature overshoot at boiling incipience. CHF is a decisive parameter when designing cooling solutions for applications with high heat flux, such as cooling of electronic components and safety systems in nuclear power reactors.

A decreased temperature overshoot at boiling incipience results in a significantly higher HTC at low heat flux and is therefore desirable in many applications (electronics cooling at low heat flux, heat pumping technology, etc.).

Such enhanced surfaces for nucleate boiling have received considerable attention during the last decades and are frequently identified as "high performance nucleate boiling surfaces"

During the past few decades, several investigations have been completed concerning the issues associated with high performance nucleate boiling surfaces. These surfaces could be manufactured either by mechanical methods or by chemical methods. Mechanical methods include the surface deformation techniques such as abrasive treatment and inscribing open grooves. Chemical methods would further be subdivided into two types; the first type being surface erosion techniques like electrolysis and chemical etching while the second type refers to the coating of a porous layer of chosen material on the boiling surface. This coated layer can be fabricated in many ways, such as sintering, spraying, painting, electroplating, etc.

However, little attention has been paid to the surface modification by nanostructuring to produce high performance nucleate boiling surfaces.

The prior art of surface modification for enhanced heat transfer in boiling used methods based on mechanical deformations or physical methods such as spraying particles to surfaces. Those methods are not capable of creating well defined nanostructured surfaces, because of the physical limitations of the mechanical techniques, and are therefore limited to the creation of less well-defined micron-sized features.

Since much of known technology has been limited to the micron-scale region, the focus of boiling research has primarily been to investigate the micron-scale influence on the boiling characteristics of a surface or an enhancement structure. Nanoscale features like surface roughness, grain boundaries, cavities between nanoparticles, rather than microscopic cavities on the heater surface, may have been responsible for the reduced nucleation energy barrier observed at the onset of nucleate boiling. Hence, to create an efficient boiling surface it is important to be able to control both the micron- and nano-scale features of the evaporator surface.

U.S. Pat. No. 4,216,826 disclose an enhanced boiling surface on a tube, which has been mechanically fabricated by deforming, compressing and knurling short integral tube fins. Since the structure can only be fabricated on circular geometries, the area of application is limited to boiling on the outside surface of tubes. The mechanical treatment also prohibits the possibilities for tailor making the nano-features of the structure.

U.S. Pat. No. 3,384,154, U.S. Pat. No. 3,352,3577 and U.S. Pat. No. 3,587,730 disclose enhanced boiling surfaces, well know commercially as the "High-Flux" surface, fabricated by sintering of metallic particles to surfaces and thus creating a porous coating. This fabrication technique is restrained to producing randomly sized cavities and with limited possibility to modify the nano-sized features of the structure. Thus, the structure is not well ordered and it is not possible to tailor make features in the nano-scale to enhance heat transfer in boiling.

JP 2002228389 relates to a heat transfer promotion approach wherein performing surface treatment which forms the boiling heat transfer side with concave convex protruding parts of the height of 10 nm to 1000 nm. The surface may consist of different metals such as aluminum and is fabricated using CVD technique or sputtering techniques followed by wet etching.

U.S. Pat. No. 4,780,373 relates to a heat transfer material for boiling produced by electrodeposition method, where a dense porous layer is formed which has dendritic miniscule projections densely formed on the surface. The layer has an average thickness of 50 μm.

Approximately 15% of all electricity produced is used for running heat pumping equipment. For each degree, the temperature difference between the heat source and the evaporating fluid is reduced; the electricity need for running the system is reduced by 2-3%. Accordingly, there is a need of enhanced surfaces in the field of heat transfer in boiling. It is an objective of the present invention to provide a surface which could be used for enhancing heat transfer in boiling as well as a new method for forming a new surface.

SUMMARY OF THE INVENTION

The object of the invention is to provide a heat exchange device, a porous layer, and a method for forming a surface layer on a substrate which overcomes the drawbacks of the prior art. This is achieved by the heat exchange device, the porous layer, and the method for forming a surface layer on a substrate as defined in the independent claims.

Advantages of the invention will be apparent from the following detailed description.

Embodiments of the invention are defined in the dependent claims.

DEFINITIONS

As used herein, the term "dendritic" means with its macroscopic form characterized by intricate branching structures of a treelike nature.

As used herein, the term "surface" means the part of the heat transfer device in contact with the boiling liquids. The surface layer with both regularly spaced and shaped micron-sized pores and a wall structure of dendritically ordered nanoparticles is applied on to the original surface of the heat transfer device, hence forming an enhanced boiling surface. The original heat transfer surface could be of any geometry such as flat, cylindrical, spherical, fin-structured, etc. and with any surface roughness.

As used herein, the term "nanoparticle" means particles having a size in at least one dimension between 1 nm to 1 μm.

As used herein, the term "surface layer with both regularly spaced and shaped micron-sized pores and a wall structure of dendritically ordered nanoparticles" means a layer with regularly spaced and regularly shaped micron-sized pores, also referred to as macro pores to more clearly distinguish them from the smaller micron-to-nano scale voids in the wall structure. These macro pores are interconnected in the direction normal to the surface of the substrate and have a diameter in the range 5 μm 1000 μm where the diameter of the pores increases with distance from the substrate. These pores are shaped by the wall structure which is comprised of nanoparticles that are dendritically ordered in three dimensions. This wall structure includes irregular voids between the dendritic branch structures. The surface layer has a thickness of 5 μm-1000 μm.

As used herein, the term "annealing" means the process of heat treatment below the melting temperature of the materials used in order to attain a larger contact between deposited nanoparticles, thus increasing the thermal conductivity and mechanical stability of the structure.

As used herein, the term "boiling" means evaporation of a liquid during bubble formation.

BRIEF DESCRIPTION OF THE DRAWINGS

FIGS. 1(1)-1(3) show typical SEM micrographs and FIG. 1(4) shows a typical TEM micrograph of a surface layer with both regularly spaced and regularly shaped micron-sized pores and a wall structure of dendritically ordered particles fabricated by electrodeposition process.

FIGS. 2(1)-2(3) show SEM micrographs of surface layer with both regularly spaced and shaped micron-sized pores and a wall structure of dendritically ordered particles fabricated by electrodeposition process with additives in the electrolytes.

DETAILED DESCRIPTION OF THE INVENTION

The porous surface layer according to the present invention comprises both a porous wall structure and regularly spaced and shaped macro-pores separated by and defined by said porous wall structure. The macro-pores are regularly spaced over the surface layer area, regularly sized and shaped, and they are interconnected in the general direction normal to the surface of the substrate and gradually increase in size with distance from the substrate. The porous wall structure is comprised of a rigid continuous branched structure of a suitable thermally conductive material. As may be seen in the explanations to the experimental results, the porous wall structure and the macro-pores both improve the boiling behavior of the surface layer, and the combination results in major advantages over the prior art.

A surface layer with both regularly spaced and shaped macro-pores that are interconnected in the general direction normal to the surface of the substrate and gradually increase in size with distance from the substrate and a wall structure of dendritically ordered nanoparticles may be formed according to the method disclosed in Shin et al. *Adv. Mater.* 15, 1610-1614 (2003) and *Chem. Mater.* 16, 5460-5464 (2004). Such a surface has metallic porous structure combined with nanoscale dendritic particles. However, Shin et al. concludes that only electrodes in electrochemical devices such as fuel cells, batteries and chemical sensors are applications of the surface.

Figure 9:
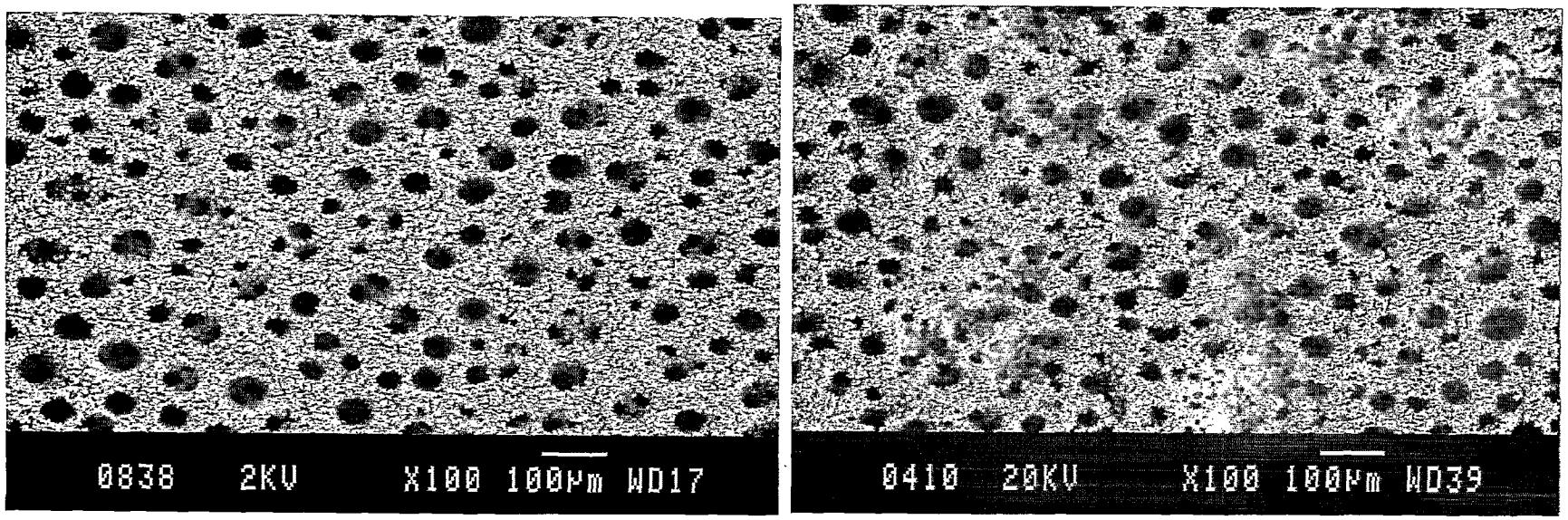
FIG. 9 shows SEM micrographs of non-annealed surface layer with both regularly spaced and shaped micron-sized pores and a wall structure of dendritically ordered nanoparticles before (top) and after (bottom) long time boiling test. The deterioration of the structure is clearly visible.
Figure 10:
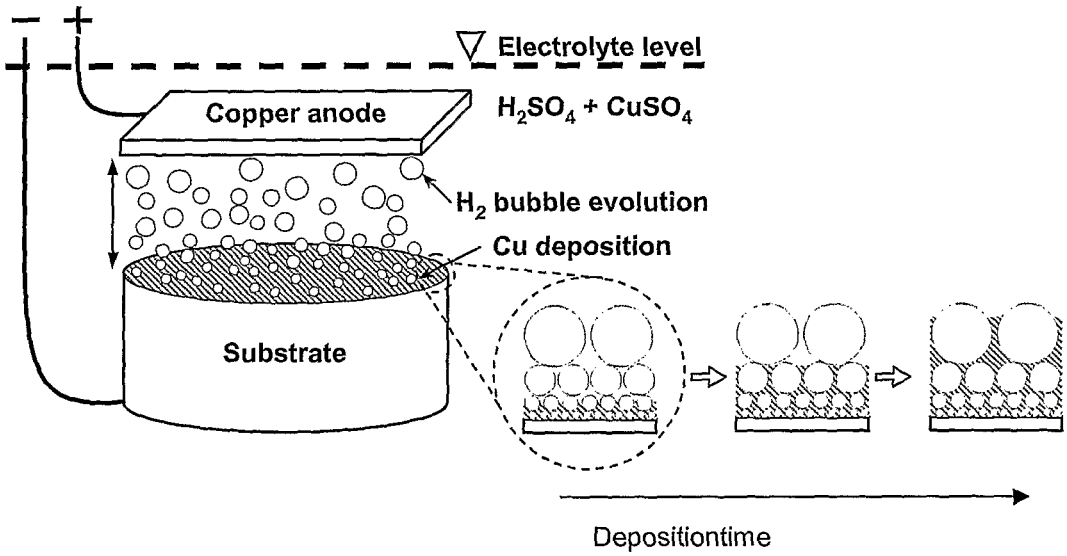
FIG. 10 schematically show an embodiment of a porous layer according to the present embodiment.

The porous wall structure disclosed by Shin et al is hereafter referred to as a structure of dendritically ordered nanoparticles. As is clearly disclosed in the large magnification SEM and TEM photos in FIGS. 1(1)-1(4), said wall structure has a distinct particle like constitution, i.e. the structure is comprised of nanoscale particles that are bonded together in a dendritic fashion. As is shown in FIG. 9 this structure is relatively weak and is degraded over time when it is used as a boiling surface.

The porous wall structure that is achieved by modifying the structure of dendritically ordered nanoparticles is hereafter referred to as a continuous branched structure. One example of such a structure is disclosed in FIG. 4*d*, where it can be seen that the particle like structure of the dendritically ordered nanoparticles is changed and the resulting structure is essentially continuous and non-particle like. FIGS. 4 *c* and *d* show examples of the porous wall structure at 5000× magnification before and after modification respectively. From these figures it can be concluded that the continuous branches in the modified structure are formed from the dendritically ordered nanoparticle structure by e.g. merging nanoparticles into continuous branches.

According to one embodiment, there is provided a heat exchange device with a boiling surface comprising a porous surface layer arranged on a solid substrate, the porous surface layer comprises a porous wall structure defining and separating macro-pores that are interconnected in the general direction normal to the surface of the substrate and have a diameter greater than 5 μm and less than 1000 μm wherein the diameter of the pores gradually increases with distance from the substrate, and wherein the porous wall structure is a continuous branched structure.

According to one embodiment, the substrate and the porous surface layer are comprised of the same or different metallic material. The metallic material can e.g. be selected from Fe, Ni, Co, Cu, Cr, Au, Mg, Mn, Al, Ag, Ti, Pt, Sn, Zn and any alloys thereof.

The boiling surface may e.g. be arranged in a plate heat exchanger, on the inside or outside of a tube in a tube-in-shell heat exchanger, on hot surfaces in electronics cooling, on the evaporating side of heat pipes, in refrigeration equipment, in air conditioning equipment and heat pumping equipment, in a thermosyphon, in a high-efficiency evaporator, in the cooling channels inside water cooled combustion engines and the like. The boiling surface may e.g. be arranged to be in contact with a fluid chosen from the group comprising of water, ammonia, carbon dioxide, alcohols, hydrocarbons, nanofluids and halogenated hydrocarbons such as hydrofluorocarbons, hydrochlorofluorocarbons.

The heat exchange device may e.g. be of pool boiling type or of flow boiling type, or a combination thereof.

According to another embodiment, there is provided a porous surface layer comprising a porous wall structure defining and separating macro-pores that are interconnected in the general direction normal to the surface of the substrate and have a diameter greater than 5 μm and less than 1000 μm wherein the diameter of the pores gradually increases with distance from the substrate, wherein the porous wall structure is a continuous branched structure.

According to one embodiment, the porous surface layer is comprised of a metallic material, e.g. selected from Fe, Ni, Co, Cu, Cr, Au, Mg, Mn, Al, Ag, Ti, Pt, Sn, Zn and any alloys thereof.

Figure 11:
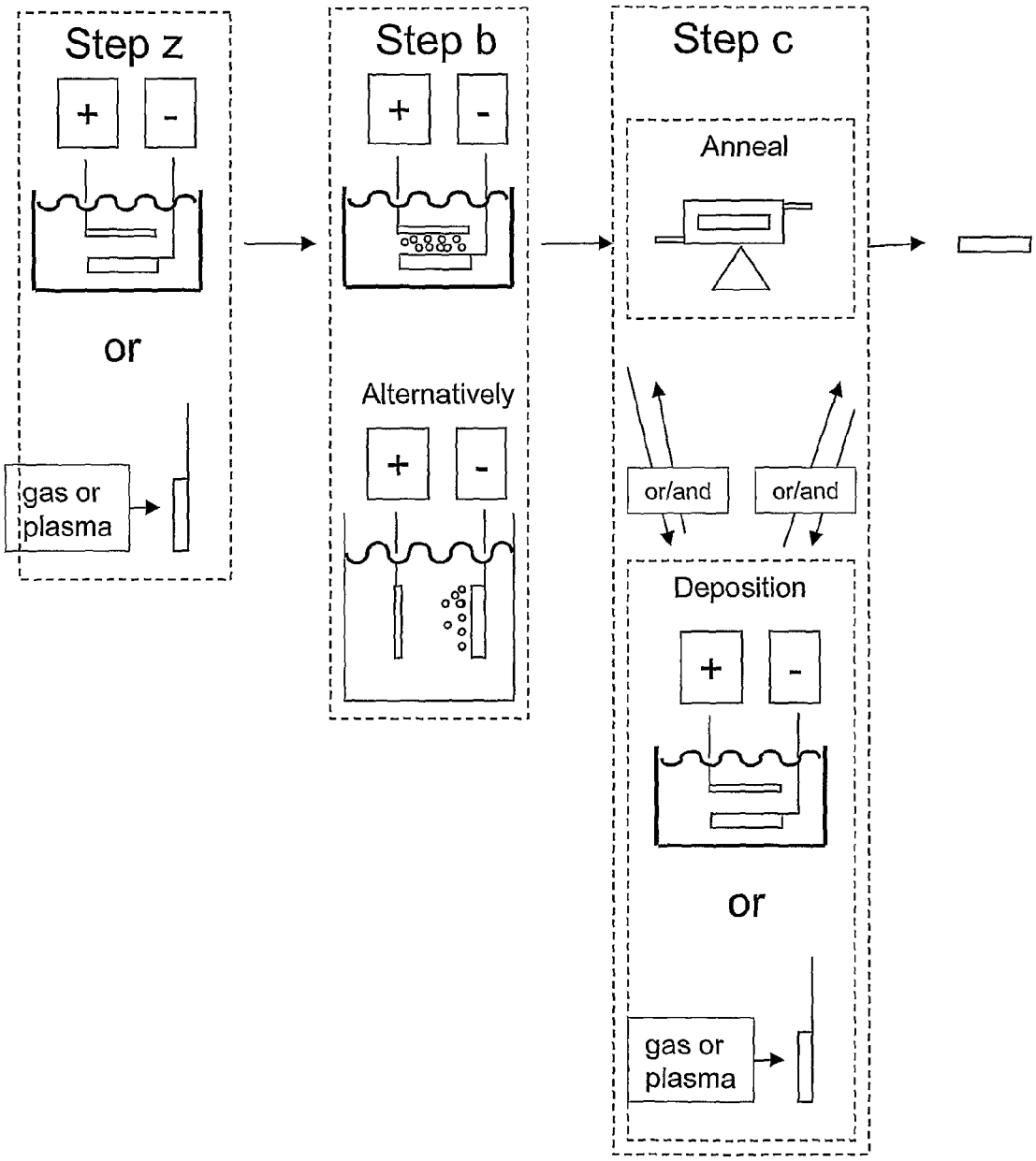
FIG. 11 schematically show the steps of a method of forming a porous layer.

According to one embodiment (FIG. 11), there is provided a method for forming a surface layer on a substrate, comprising the steps:

depositing (FIG. 11 step b) a surface layer comprising a porous wall structure defining and separating macro-pores that are interconnected in the general direction normal to the surface of the substrate and have a diameter greater than 5 μm and less than 1000 μm wherein the diameter of the pores gradually increases with distance from the substrate, wherein the porous wall structure is comprised of dendritically ordered nanoparticles and modifying (FIG. 11 step c) the porous wall structure to a continuous branched structure.

According to one embodiment, the step of modifying the porous wall structure involves annealing (FIG. 11 Anneal) the surface layer at a temperature greater than 100° C. and less than the melting point of the deposited material, under non-oxidizing atmosphere.

The annealing time strongly depends on the annealing temperature and the degree of annealing that is required, and can therefore be essentially any value greater than a few seconds, to several days. The annealing time may e.g. be greater than 1 second, 1 minute, 1 hour or 1 day, and less than 10 seconds, 10 minutes, 10 hours or 5 days.

According to one embodiment, the step of modifying the porous wall structure involves controlled deposition (FIG. 11 Deposition) of a thin solid layer on the surface of the porous wall structure. The thin solid layer may e.g. have a thickness greater than 1 nm, 10 nm or 100 nm, and less than 500 nm, 1 μm, or 10 μm. According to one embodiment, the deposition of the thin solid layer is performed by electrodeposition or gas phase deposition.

According to one embodiment the method comprises the step of controlled deposition (FIG. 11 step z) of 1 nm to 10 μm solid layer on the substrate surface prior to the step of depositing the surface layer.

According to one embodiment, the surface layer is deposited by a controlled electrodeposition process generating gas bubbles that define the macro-pores, thereby depositing the material on the substrate in order to form a surface layer with both regularly spaced and shaped micron-sized pores and a wall structure of dendritically ordered nanoparticles.

According to one embodiment, the surface layer is deposited by a controlled gas phase deposition process generating gas bubbles that defines the macro-pores, thereby depositing the material on the substrate in order to form a surface layer with both regularly spaced and shaped micron-sized pores and a wall structure of dendritically ordered nanoparticles.

According to one embodiment, the deposited material is a metal such as Fe, Ni, Co, Cu, Cr, Au, Mg, Mn, Al, Ag, Ti, Pt, Sn, Zn and any alloys thereof.

An embodiment of a method for forming a new surface layer with both regularly spaced and shaped micron-sized pores and a wall structure of dendritically ordered nanoparticles comprises the steps of:

a) providing a substrate in an electrolyte solution comprising the metal ions to be deposited on the substrate;

b) performing a controlled electrodeposition process generating gas bubbles, thereby depositing the materials on the substrate in order to form a surface layer with both regularly spaced and shaped micron-sized pores and a wall structure of dendritically ordered nanoparticles; and c) annealing the created surface layer with both regularly spaced and shaped micron-sized pores and a wall structure of dendritically ordered nanoparticles on the substrate at a temperature in the interval of 100° C. and melting point of the selected materials, under non-oxidizing atmosphere.

In the above method, between steps a) and b), and/or between the steps b) and c), and/or after step c, or instead of step c, it is possible to incorporate a step z):

z) performing a controlled deposition process without generating gas bubbles, thereby depositing the materials in order to form a thin solid layer of the deposited materials either onto the substrate or onto the porous structure.

The deposition process in step z) can be a deposition process that does not generate gas bubbles such as gas phase deposition or electrodeposition. The generation of gas bubbles is controlled by the proper selection of processing parameters.

A low current density, <0.5 A/cm$^2$ can be applied in step z) for deposition of a thin fine-coating layer, prior or subsequent to controlled electrodeposition process generating gas bubbles. This low current density deposition will further improve the adhesion between the deposited surface layer and the substrate, and will also enhance the stability of the deposited surface layer structure itself. Other methods such as thermally evaporating thin layer of atoms or molecules of deposited materials could also fulfill the purpose to further enhance the adhesion and the stability of the surface structures.

The term materials include metals and similar materials useful within the scope of the present invention.

Other methods may also form a surface layer with both regularly spaced and shaped micron-sized pores and a wall structure of dendritically ordered nanoparticles, such as gas phase deposition which comprises the steps of:

a) providing a substrate for the gas phase deposition
b) performing a controlled deposition process, thereby depositing the materials on the substrate in order to form a surface layer with both regularly spaced and shaped micron-sized pores and a wall structure of dendritically ordered nanoparticles; and
c) annealing the created surface layer with both regularly spaced and shaped micron-sized pores and a wall structure of dendritically ordered nanoparticles on the substrate at a temperature in the interval of 100° C. and melting point of the selected materials, under non-oxidizing atmosphere.

The surface layer could be annealed after deposition during a time period of between a 1 minute to 5 days, preferably 1 h to 24 hours.

The present invention is yet further directed to a new surface layer with both regularly spaced and shaped micron-sized pores and a wall structure of dendritically ordered nanoparticles deposited on a surface characterized in that it has been formed by any of the methods disclosed above.

The resulting regularly spaced and shaped micron-sized pore density, based on the projected top area of the layer, is 1-1000 pores/mm$^2$.

Further, a surface layer with both regularly spaced and shaped micron-sized pores and a wall structure of dendritically ordered nanoparticles, wherein the surface layer is annealed after deposition in a temperature range between 100° C. and the melting point of the deposited material.

A surface layer with both regularly spaced and shaped micron-sized pores and a wall structure of dendritically ordered nanoparticles wherein the deposited metals are chosen as single metals or any combination of metals including Fe, Ni, Co, Cu, Cr, Au, Al, Ag, Ti, Pt, Sn and Zn and their alloys. However, any metal or combination thereof could be used for the purpose of the invention, as long as the desired properties are obtained.

A surface layer with both regularly spaced and shaped micron-sized pores and a wall structure of dendritically ordered nanoparticles, wherein the bulk materials are deposited on selected substrates being single metals or any combination of metals including Fe, Ni, Co, Cu, Cr, Au, Al, Ag, Ti, Pt, Sn and Zn and their alloys. However, any metal or combination thereof could be used for the purpose of the invention, as long as the desired properties are obtained.

A surface layer with both regularly spaced and shaped micron-sized pores and a wall structure of dendritically ordered nanoparticles disclosed above wherein a suitable deposition process is used, preferably electrodeposition or gas phase deposition.

The new surface layer with both regularly spaced and shaped micron-sized pores and a wall structure of dendritically ordered nanoparticles formed according to the novel method above could be used in the field of boiling for applications chosen from all types of heat exchangers such as plate heat exchangers, inside and/or outside tubes in tube-in-shell heat exchanger, hot surfaces in electronics cooling, the evaporating side of heat pipes, refrigeration equipment, air conditioning equipment and heat pumping equipment, thermosyphons, high-efficiency evaporators. It could also be used for enhancing boiling heat transfer in the cooling channels inside water cooled combustion engines and the like. The new surface layer formed according to the novel method above is preferably used to enhance heat transfer in boiling.

During boiling, the liquid in contact with the surface layer with both regularly spaced and shaped micron-sized pores and a wall structure of dendritically ordered nanoparticles could be selected from the group comprising of water, ammonia, carbon dioxide, alcohols, hydrocarbons, nanofluids and halogenated hydrocarbons such as hydrofluorocarbons, hydrochlorofluorocarbons. However, any liquid or combination thereof could be used for the purpose of the invention, as long as the desired properties are obtained.

Boiling with a surface layer with both regularly spaced and shaped micron-sized pores and a wall structure of dendritically ordered nanoparticles in contact with liquids includes a stagnant liquid pool, so called pool boiling, and the case when the liquid is in motion over the surface, so called flow boiling, of the liquids on the surface.

The surface layer with both regularly spaced and shaped micron-sized pores and a wall structure of dendritically ordered nanoparticles disclosed above could also be arranged in a heat transfer device.

By the annealing, the bonds between the particles are strengthened, thereby increasing the stability of the structure as well as the thermal conductivity of the structure. Furthermore, the morphology in nano-scale can, by annealing, is tailored so as to produce an optimized structure in terms of the size of deposited features and the size of pores that results in the best heat transfer performance for a specific application.

The annealing and its possibility of tailoring the structure makes the present invention's structural features completely different from prior art. The difference is evident in the SEM pictures, i.e. increased branch and particle size in the nano-scale region.

Further, the electrical and thermal conductivity of the structure should be higher than in disclosed prior art after annealing under due to that the oxide layer on the surface is eliminated/reduced and that interconnectivity of the nanoparticles is increased and the grain boundary effect of nanoparticles is reduced.

The novel method is very cost efficient compared to existing fabrication methods of boiling surfaces.

Experimental Results:

The change of interconnectivity and change of grain boundary can be seen in FIG. 4. Boiling tests show that the mechanical stability of the structure improves with annealing which is shown from experimental tests in FIG. 8 and in FIG. 9. The deterioration of the structure during boiling worsens the heat transfer capability over time. Hence, the increase in temperature difference in FIG. 8. The deterioration of the structure is also confirmed visually from SEM micrographs in FIG. 9.

In the present invention the distance between electrodes during electrode positioning is variable from 1 to 100 mm and a current density ranging from 1 to 10 A/cm$^2$ can be used. The process does not require a high-purity—Cu, or other type—surface.

Further, a wide range of roughness of the surface before electrodeposition can be accepted (from smooth surfaces with 5 nm RMS to regular machined surfaces with large surface roughness), which is not defined in prior art. A wide range of pressures, between 0.1 bar and 10 bar, was used during electrodeposition in order to control the pore size.

Electrodeposition has been performed at different positions of anode and cathode. In prior art horizontally parallel alignment with cathode (substrate, surface) facing up and anode facing down with a 2 cm distance should be used. In the present invention all types of parallel alignments are possible; horizontally with cathode facing up or facing down, vertically, or at any angle with the distance between electrodes ranging from 1 to 100 mm for the system. The advantage with this is that we can apply the structure to any geometry with any alignment of electrodes. By changing the direction it is possible to alter the morphology of the structure and at certain alignments use lower current density. This opens up the possibility to apply and tailor the structure for many different applications.

Figure 8:
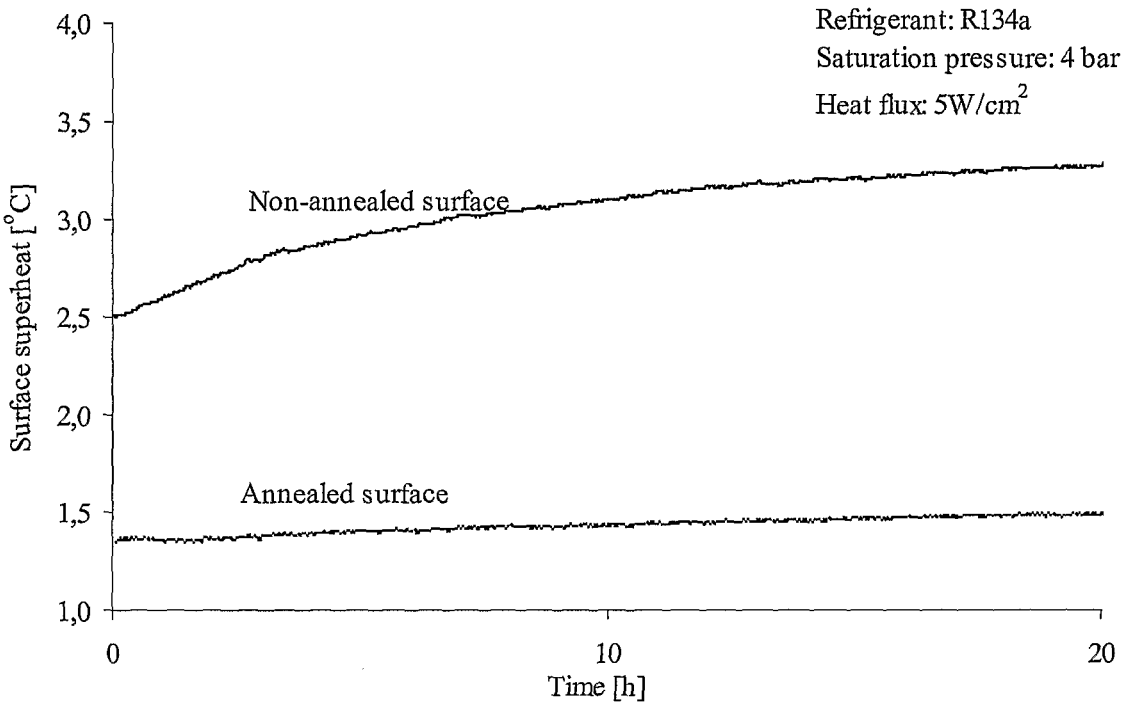
FIG. 8 shows deterioration of non-annealed surface during long time boiling test at 5 W/cm$^2$ and the stability of the annealed surface during the same test.

Heat transfer performance of the surface layer with both regularly spaced and shaped micron-sized pores and a wall structure of dendritically ordered nanoparticles is significantly enhanced by the annealing process, since heat transfer is dependent on the thermal conductivity of the dendritic structure. The annealing process has been experimentally proven to improve the heat transfer capabilities of the structure and the mechanical stability of the structure. The mechanical stability of the structure is an important feature during the boiling conditions for the usability of the invention. Experimental tests have shown that the non-annealed surface degenerates during long time boiling tests, while the annealed surface does not degenerate. An example of deterioration of non-annealed surface during boiling over longer time periods is shown in FIG. 8 using a saturation pressure of 4 bar and a heat flux of 5 W/cm$^2$. As the non-annealed structure falls apart during boiling its effectiveness as an enhanced surface diminishes and the temperature difference increases with time. Visual inspection of the non-annealed surface after long duration boiling confirms that the structure has been deteriorated significantly.

Eight different surface layers with both regularly spaced and shaped micron-sized pores and a wall structure of dendritically ordered copper nanoparticles have been manufactured and tested for their boiling heat transfer capabilities. Tests were conducted in a pool of saturated R134a at a pressure of 4 bar and at heat flux in the range of 0.1 to 10 W/cm$^2$. Possible reasons for the high boiling performance of the structure have been discussed. The main conclusions from the study were:

Important variables were identified that affect the production of the structure and its features, such as surface orientation during electrodeposition, pressure and temperature of electrolyte, and a final heat treatment of the surface under reduced atmosphere.

The structure has been shown to display excellent boiling characteristics with temperature differences less than 0.3° C. and 1.5° C. at heat fluxes of 1 and 10 W/cm$^2$ respectively and with the stable performance over time, above 80 hours.

Annealing treatment for 5 hours at 500° C., increases the grain size of the dendritic branches and improves the connectivity between the grains. These micro- and sub-micron scale alterations to the structure are suggested as explanations to the improved the heat transfer capabilities of the structure after annealing. The suitability of the structure as an enhanced boiling surface has been attributed to its high porosity (~94%), a dendritically formed and exceptionally large surface area, and to a high density of well suited vapor escape channels (50-1500 per mm$^2$).

Additives in the electrolyte have shown to have large effects on the morphology and physical properties of deposited materials, such as brightness, smoothness, hardness and ductility. In the present invention, additives in the electrolyte will change the morphology of the structure both in macro-scale (μm-scale) and micro-scale (nm-scale), resulting in different performance in the following boiling tests. For example, by adding little amount of HCl, the three-dimensional interconnection of the structures changes greatly and the nano-scale branch size reduces dramatically, as seen in FIGS. 2(1)-2(3).

Figure 3:
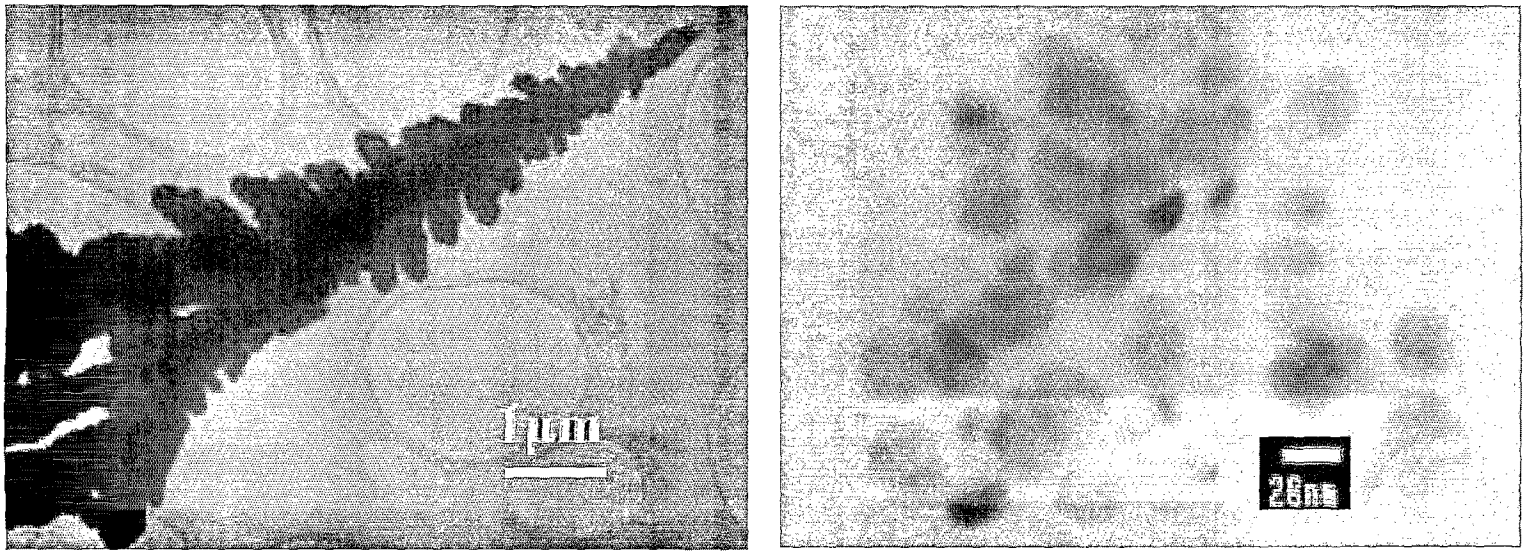
FIG. 3 shows TEM micrographs of the nanoparticles scratched from the substrate surface produced by electrodeposition process.

TEM micrographs of the nanoparticles powders scratched from the substrate surface produced by electrodeposition process is seen in FIG. 3.

An uncertainty analysis of the experimental measurements has been made, where the objective was to assess the uncertainty of the reported heat transfer coefficient measurements. The Kline and McClintock 1953, "Describing Uncertainties in Single Sample Experiments", Mechanical Engineering, 75, pp. 3-8. approach to describe uncertainty in experiments has been used. The heat transfer coefficient (HTC) is a function of 4 independent variables: current through heater (I), resistance of heater (R), diameter of boiling surface (d) and temperature difference between surface and bulk test liquid (ΔT). Table 1 presents the uncertainty of each variable.

TABLE 1

| Variable | Uncertainty interval for variable (20:1 odds) | Source of uncertainty estimate |
|---|---|---|
| Current (I) | 0.1% × I | Instek PSP-405 user manual |
| Resistance (R) | 0.05% × R | Fluke 45 Dual Display Multimeter data sheet |
| Diameter of surface (d) | 0.1 mm | Calibration of micrometer against precision micrometer |
| Temperature difference (ΔT) | 0.1° C. | Calibration and experience |

Since the enhanced surfaces were boiling with small temperature differences in the heat flux range presented here, the accuracy of the temperature measurement had the major influence on the calculated HTC, see Table 2. Hence, measurements at lower heat flux, i.e. resulting in small ΔT and better performing surfaces (heat transfer at small ΔT) had the largest overall uncertainty. The resolution for voltage measurement in the data logger corresponded to 0.008° C. and the maximum error to ±0.06° C. with a function error (conversion from voltage to temperature) of less than ±0.001° C. in the applicable range. At thermally stable conditions all temperatures in the experimental set-up were within ±0.04° C. and the standard deviation during calibration was less than 0.001° C.

With the extensive calibration and considering that temperature differences were measured, the uncertainty interval for the temperature difference (ΔT) has been estimated to 10.1° C. (20:1 odds). Since the temperature was measured 2 mm under the surface the resulting temperature drop between measuring point and surface has been corrected, by using Fourier's law of conduction and with a thermal conductivity of the copper of 400 Wm$^{-1}$K$^{-1}$. The uncertainty in the exact location of the thermocouple, ±0.1 mm, has been factored into the error analysis, resulting in ±0.025° C. additional uncertainty in the temperature difference (ΔT) at high heat flux (10 W/cm$^2$) and ±0.0025° C. at low heat flux (1 W/cm$^2$).

Table 2 presents the results of the error analysis for two different surfaces, the reference surface and an enhanced surface at high and low heat flux (1 W/cm$^2$ and 10 W/cm$^2$ respectively) at 4 bar. Heat losses through the Teflon insulation has been calculated using a finite element solver (FEMLAB 3.0) and free convection correlations from Incropera and DeWitt, Fundamentals of Heat and Mass Transfer, Wiley, pp. 545-551, Chap. 9. The relative heat loss is presented at the bottom of Table 2. The HTC presented in this work have not been adjusted for the quantified heat loss. The overall combined uncertainties of two selected test surfaces are also included in FIG. 7.

TABLE 2

| | Reference Surface | Reference Surface | Enhanced Surface | Enhanced Surface |
|---|---|---|---|---|
| Heat Flux [W/cm$^2$] | Low (1.0) | High (10.0) | Low (1.0) | High (10.4) |
| h - Heat Transfer Coefficient [W/cm$^2$ K] | 0.26 | 1.18 | 4.47 | 6.87 |
| | Uncertainty contribution to h from variable | | | |
| I | ±0.2% | ±0.2% | ±0.2% | ±0.2% |
| R | ±0.1% | ±0.1% | ±0.1% | ±0.1% |
| D | ±1.4% | ±1.4% | ±1.5% | ±1.5% |
| ΔT | ±2.6% | ±1.2% | ±43% | ±6.6% |
| Overall combined uncertainty in h | ±3.0% | ±1.9% | ±43% | ±6.7% |
| Heat loss through insulation block | 11.2% | 1.9% | 0.9% | 0.5% |

Enhanced Surface and its Fabrication

For the fundamentals of the electrodeposition process and the fabrication of the structure and the influence of various parameters reference is made to Li, S., 2004 "Surface Engineering for Energy Applications", Master Thesis, Royal Institute of Technology, Stockholm and to Shin et al. "Nanoporous Structures Prepared by an Electrochemical Deposition Process", Advanced Materials, 15, (19), pp. 1610-1614.

For the fabrication of one of the tested surfaces the following procedure was used: A polished copper cylinder was used as the cathode and a copper plate was used as the anode. The two electrode surfaces were fixed parallel in the electrolyte at a 20 mm distance. The electrolyte was a solution of 1.5M sulphuric acid ($H_2SO_4$) and various concentrations of copper sulphate ($CuSO_4$). During the deposition a constant DC current was applied, using a precision DC power supply (Thurlby-Thandar TSX3510). The deposition was performed at a room tempered, stationary electrolyte solution without stirring or $N_2$ bubbling. Electrodeposition is recognized as a suitable process to build and modify three-dimensional structures, see Xiao et al. 2004, "Tuning the Architecture of Mesostructures by Electrodeposition", J. Am. Chem. Soc. 126, pp. 2316-2317.

Hydrogen evolution during electrodeposition is usually suppressed, since it causes low current efficiency and decreases the density of the deposited metal layer. The hydrogen bubble evolution on the cathode is precisely the factor that leads to the formation of desirable regularly spaced and shaped micron-sized porous structure, herein also referred to as macro-pores. SEM and TEM images of the micron-sized porous structure and the dendritic sub-structure are shown in FIGS. 1(1)-1(4), wherein the SEM images are marked as FIGS. 1(1)-1(3) and the TEM image is marked as FIG. 1(4). Detailed analysis of the dendritic branches showed that the branches comprise nano-sized grains between 1-1000 nm.

During the deposition, the growth of the dendritic copper structure was blocked at certain locations by the hydrogen bubbles, wherefore the hydrogen bubbles functioned as a dynamic masking template during the deposition. The hydrogen bubbles depart from the surface, rise and merge into larger bubbles, and as a result the pore size of the deposited copper structure increase with the distance from the surface, which can be clearly seen from SEM images of structures fabricated with various deposition time. The deposition process can be described as a competition between hydrogen evolution and coalescence away from the surface and metal deposition on to the surface. At low current density, <2 A/cm$^2$, the frequency and nucleation density of the hydrogen bubbles were low, resulting in a dense dendritic structure without any pores, but where only traces of the hydrogen bubble template could be seen at the SEM images. At increasing current density, >3 A/cm$^2$, the bubble population, frequency and coalescence increased to such an extent that the bubbles created permanent voids above the cathode and thereby functioned as a masking template, producing the desired structure. Film electrolysis, blocking the Cu deposition, occurs at very high current densities, which is a phenomenon analogous to film boiling.

Figure 5:
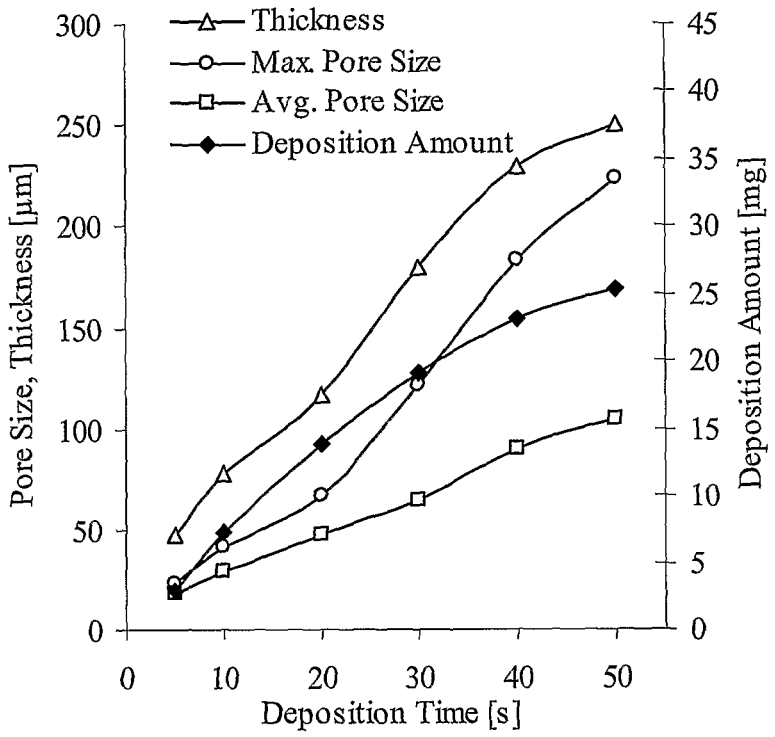
FIG. 5 shows various characteristics of the surface layer with both regularly spaced and shaped micron-sized pores and a wall structure of dendritically ordered particles as a function of deposition time.

Several different parameters have been found to affect the electrodeposition process and characteristics of the dendritic structure, both on a nano- and micro-scale. The most important are deposition time, current density and molar concentrations of sulphuric acid and copper sulphate. As illustrated in FIG. 5 thickness, pore size and deposition amount are almost linear functions of the deposition time at 1.5M $H_2SO_4$ and 0.4 M $CuSO_4$. The orientation of the cathode was also affecting the dynamics of the hydrogen evolution and the Cu deposition. All pool boiling results and discussions have been based on an electrochemical deposition process where the cathode is in a horizontal position facing up 0°, but it has been found that the deposition can also take place with the cathode in any position. With the cathode at a vertical angle 90° the result was almost identical to that of 0°. But, with the cathode facing down 180° the hydrogen bubbles would not easily escape, but rather coalescence and eventually form a large bubble covering the whole surface. Hence the Cu deposition was completely obstructed after approximately 25 sec. of deposition. The structure was similar to the ones made at 0° and 90°, but since the growth only continued for 25 sec. there was a limit to the thickness of the structure. Further, since the bubbles coalesced and stayed on the surface at 180° deposition, less current density was needed to create the porous structure.

Since the structure may be fabricated on a surface of any direction, it is possible to apply the surface layer with both regularly spaced and shaped micron-sized pores and a wall structure of dendritically ordered nanoparticles on many different geometries that might be interesting heat transfer applications, such as plate heat exchangers, inside and outside of tubes, fins, etc. Different additives in the electrolyte, temperature and pressure are also parameters that can be varied, with a change in both the dendritic formations and the size and shape of the pores in the structure as a result. The dendritic surface produced by the outlined method is fairly fragile.

Figure 4B:
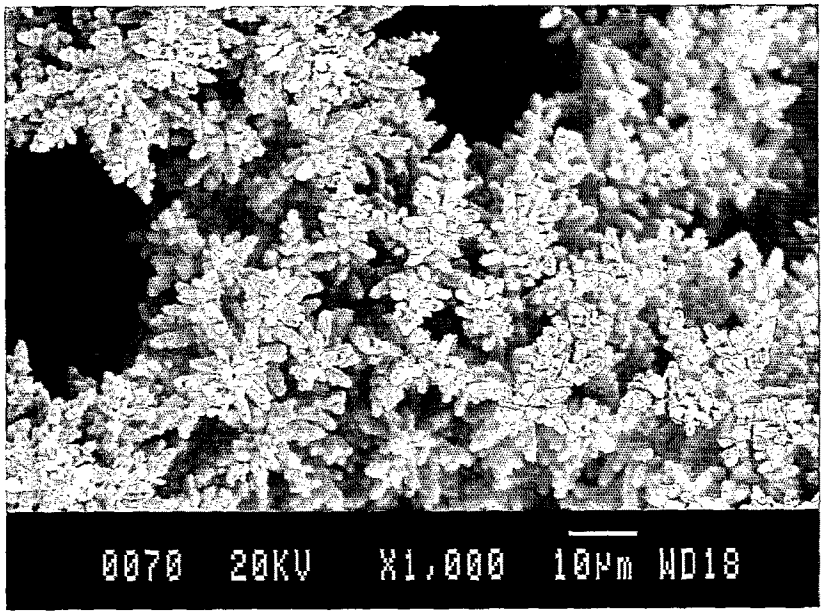
FIGS. 4*a*-4*b* and 4*c*-4*d* show dendritic structure before (left side) and after (right side) annealing.
Figure 4A:
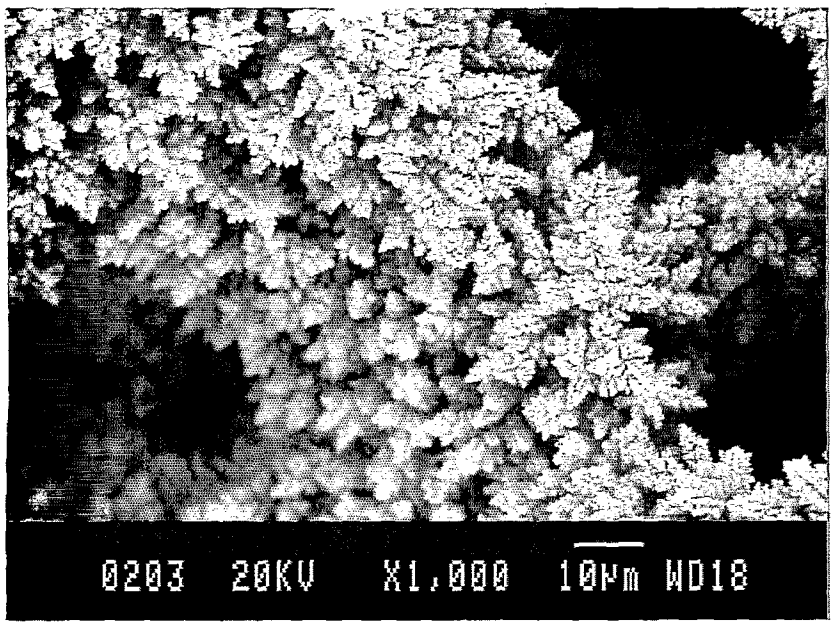
Figure 4D:
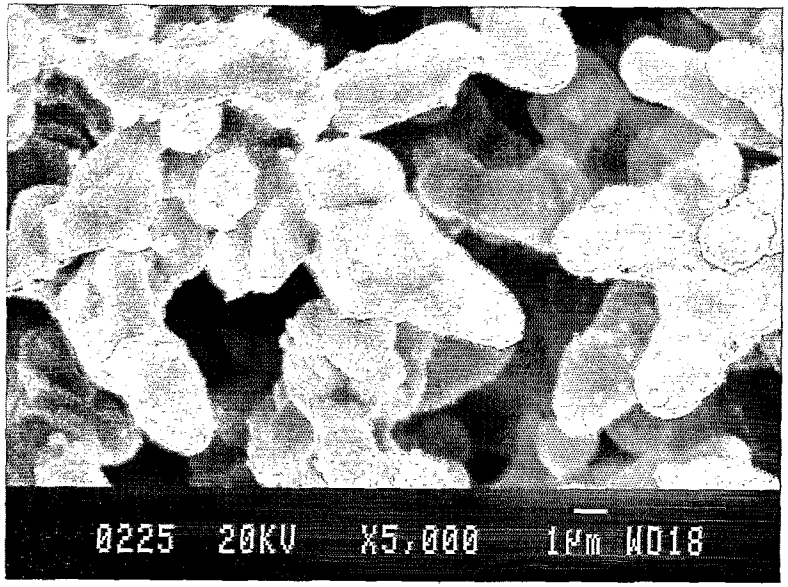
Figure 4C:
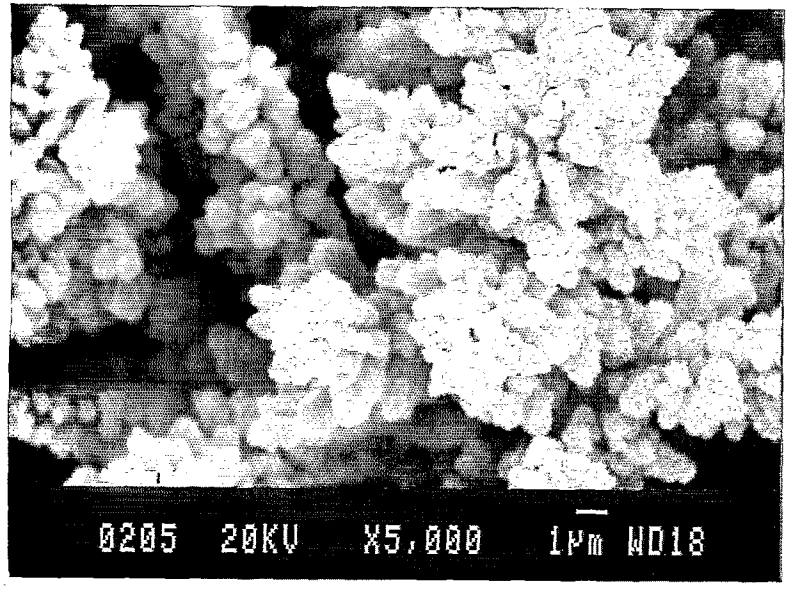

The annealing process stabilizes the structure and further enhances boiling heat transfer under most conditions. During annealing, the surface was placed in an oven where it was exposed to a high temperature hydrogen gas. The annealing treatment presented was done for 5 hours at 500° C., excluding warm up and cool down time of the oven. After the annealing treatment, the micron-sized porous structure remained intact (pore size, thickness, pore density), but the sub-micron related features of the structure changed due to the growth of the grain size of the dendritic branches. FIGS. 4*a* and 4*c* show the surfaces before annealing and FIGS. 4*b* and 4*d* show after annealing. As the grains grew during annealing treatment, also the interconnectivity and the stability of the whole structure increased, which was easily verified visually. The final grain size of dendritically ordered nanoparticles after annealing is in the range 1 nm to 2000 nm.

Surface roughness, in form of scratches and indents, was observed to result in various irregularities in the structure. Hence, to ensure high repeatability, all copper cylinders were prepared under controlled conditions. The surfaces were first polished with rotating emery paper, with increasingly fine granularity, and, as a last step, polished with diamond paste (1 μm) on a rotating disk. The resulting surface roughness was measured to about 5 nm<RMS<10 nm (Talystep). To remove dusts and organic compounds, the surfaces were treated in an ultrasonic acetone bath before electrodeposition.

trails of growing and interconnected pores are left, shaping channels which penetrate the whole structure from the base to the top. This feature, together with the high pore density: 470, 150, and 100 per $mm^2$ at different heights of the structure: 80, 120, and 220 μm respectively, ensure that the vapor produced, during evaporation inside the structure, can quickly be released with low resistance from the dendritic structure. The interesting resemblance between the manufacturing process of the structure and the boiling phenomena itself is striking. The departing hydrogen bubbles are seeking the lowest resistance path, thus creating low impedance vapor escape channels.

SEM images of the 80 μm-a structure, reveal that the increase of dendritic grain size has defected the shape of many of the small surface pores in the structure, thereby adding resistance to vapor and liquid flow as compared to the non-annealed structure of same thickness. Hence the 80 μm-a surface performed worse than its non-annealed counterpart. This observation of the 80 μm-a structure confirms that the vapor escape channels are important for effective mass transport.

TABLE 3

| | Surface | | | | | | |
|---|---|---|---|---|---|---|---|
| | 80 μm | 120 μm | 220 μm | 80 μm-a | 120 μm-a | 220 μm-a | 265 μm-a |
| Thickness [μm] | 80 | 120 | 220 | 80 | 120 | 220 | 265 |
| Pore Diameter μm] | 30 | 45 | 65 | 30 | 45 | 65 | 105 |
| Pore Density [N/$mm^2$] | 470 | 150 | 100 | 470 | 150 | 100 | 75 |
| Porosity [%] | 94 | 92 | 94 | 94 | 94 | 93 | 94 |
| Annealing | No | No | No | 5 h at 500° C. | 5 h at 500° C. | 5 h at 500° C. | 5 h at 500° C. |

Figure 6:
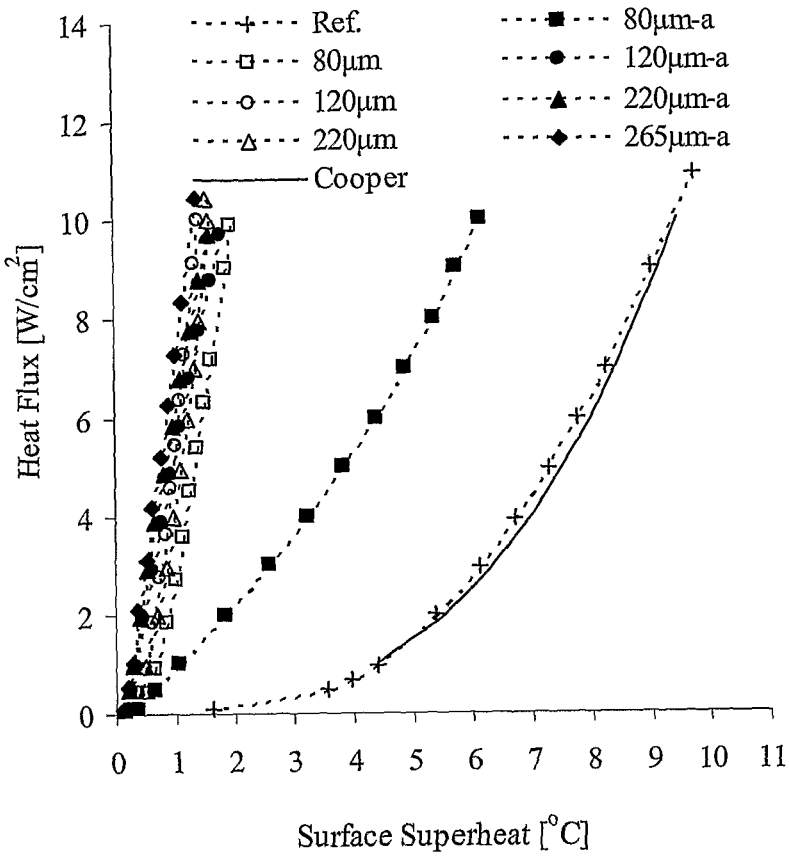
FIG. 6 shows boiling curves of enhanced surfaces and machined reference surface.
Figure 7:
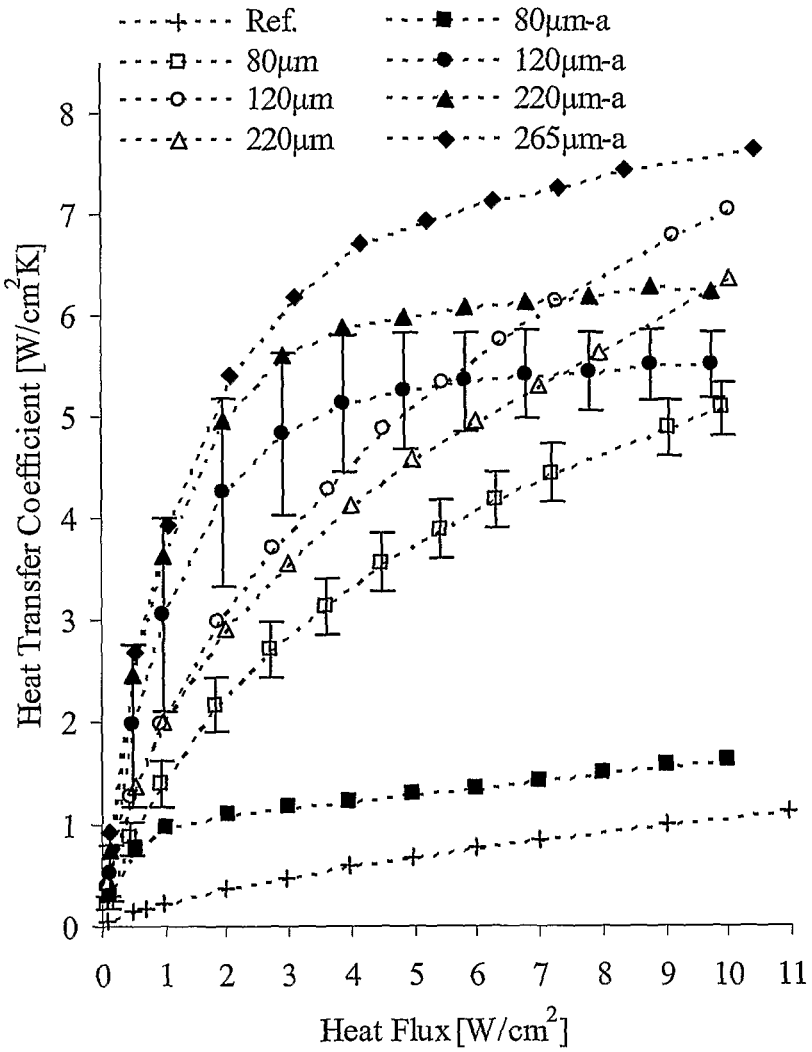
FIG. 7 shows the Heat Transfer Coefficient vs. Heat Flux, including uncertainty estimates for two surfaces.

Table 3 presents a summary of some structure characteristics of the seven surfaces that have been tested. FIG. 6 shows boiling curves of the eight different surfaces, including the reference surface. To further illustrate the boiling characteristics of the different structures FIG. 7 shows the heat transfer coefficient vs. heat flux. FIG. 7 also presents the uncertainty limits of two selected surfaces. As seen in FIG. 6 the reference surface closely follows the well-known correlation suggested by Cooper "Heat Flow Rates in Saturated Nucleate Pool Boiling—A Wide Ranging Examination Using Reduced Properties", *Advances in Heat Transfer*, Academic Press, Orlando, pp. 203-205. (4 bar, 2 $R_P$). All of the enhanced surfaces sustained nucleate boiling at lower surface superheat than the reference surface. The 120 μm-annealed (120 μm-a) and 220 μm-a surfaces performed better than their non-annealed counterparts up to 7 W/$cm^2$, above which the non-annealed surfaces performed slightly better. At low heat flux, the annealed surfaces, 120 μm-a and 220 μm-a, performed exceptionally well with surface superheats of approx. 0.3° C. at 1 W/$cm^2$. This is to be compared to 4.4° C. for the reference surface at the same heat flux, which is an improvement of the HTC with over 16 times. At high heat flux, 10 W/$cm^2$, non-annealed surface, 120 μm, had a superheat of 1.4° C., when the reference surface was recorded at 9.4° C., an improvement of almost 7 times of the HTC.

The remarkably effective heat transfer capabilities of the structure are suggested to be caused by the following characteristics of the structure:

Suitable vapor escape channels. The pores in the structure, seen from a top view in FIGS. 1(1)-1(4) and FIGS. 4*a-d*, are believed to act as vapor escape channels during the boiling process. Since the pores are formed by the template of the rising hydrogen bubbles during the electrodeposition process High Porosity.

The unusually high porosity of the structure, calculated by comparing the measured density of the structure with the density of copper, promotes the influx of liquid and the outflow of vapor. FIG. 8 shows the result of an almost 20 hour long boiling test at 5 W/$cm^2$. The stability of the superheat of the surface, only an increase of 0.05° C. was recorded, which was reversed upon restart, indicates that no major dry patches of vapor are formed inside the structure, but that the liquid supply through the porous structure is efficient. Otherwise dry vapor patches would grow in size and create local dry spots on the surface. The long time boiling test also shows the durability of the structure.

Dendritic Branch Formation.

The structure, as seen in FIGS. 1 and 4, features an exceptionally large surface area, which could facilitate large formations of thin liquid films with high evaporation rates for the porous surface. Further, the dendritic branch formations in the structure, with its jagged cross-section, may generate a long three-phase-line formed by intersection of the vapor-liquid interface with the dendritic branches as an important boiling enhancing mechanism in protruding micro-structures.

The boiling characteristics of the annealed vs. the non-annealed surfaces seem to indicate that there was an influence of the surface irregularities on the dendritic branches, formed by the micron to sub-micron scale particles. The larger surface area of dendritic branches of the non-annealed structures, as seen in FIGS. 1 and 4, could be the explanation to the continued increase of the HTC, even at higher heat flux, as seen in FIG. 7.

At lower heat flux, the improved interconnectivity of the grains, on a nano- and micro scale, resulting in increased thermal conductivity of the annealed structures, is suggested as an explanation to the improved performance of the annealed structures over the non-annealed structures. Among the annealed surfaces, thicker structures performed better than thinner ones, but for the non-annealed structures, the performance was diminishing with structures of greater thickness than 120 μm. This behavior could be related to the thickness of the superheated thermal boundary layer. Additional height of the structure, beyond the thickness of the thermal boundary layer, increases the hydraulic resistance to the vapor and liquid flow inside the structure and therefore inhibits the heat transfer performance of the structure. The thickness of the superheated thermal boundary layer is a function of the thermal conductivity of the structure. Hence, the annealed structures, with their improved thermal conductivity, displayed better performance with increased thickness, even beyond 120 μm.

The invention claimed is:

1. A method for forming a surface layer on a substrate, comprising the steps of:

providing a substrate having a copper surface cathode;

depositing a surface layer on the surface of the substrate by electrodeposition from a copper anode in a solution of copper sulphate and 1.5M sulpheric acid, the surface layer comprising a porous wall structure defining and separating macro-pores that are interconnected in the general direction normal to the surface of the substrate and that have a diameter greater than 5 μm and less than 1000 μm, wherein the diameter of the pores gradually increases with distance from the substrate, and wherein the porous wall structure comprises dendritically ordered copper nanoparticles; and modifying the porous wall structure to a continuous branched structure formed of the dendritically ordered copper nanoparticles that have been modified by annealing at 500° C. for 5 hours to increase a grain size of the nanoparticles and reduce a boundary effect of the nanoparticles, wherein a boiling surface comprising the surface layer on the substrate maintains stable performance for over 80 hours in a pool of saturated R134a at a pressure of 4 bar and at a heat flux between 0.1 W/cm$^2$ and 10 W/cm$^2$ so as to have a surface superheat temperature difference of less than 0.3° C. at a heat flux of 1 W/cm$^2$ and a surface superheat temperature difference of less than 1.5° C. at a heat flux of 10 W/cm$^2$.

2. The method according to claim 1, wherein the step of modifying the porous wall structure comprises controlled deposition of a 1 nm to 10 μm solid copper layer on the porous wall structure.

3. The method according to claim 1, comprising the step of depositing via controlled deposition a 1 nm to 10 μm solid copper layer on the substrate surface prior to the step of depositing the surface layer.

4. The method according to claim 3, wherein the deposition of the solid copper layer is performed by electrodeposition or gas phase deposition.

5. The method according to claim 1, wherein the surface layer is deposited by a controlled electrodeposition process generating gas bubbles that define the macro-pores, thereby depositing the material on the substrate to form the surface layer with both regularly spaced and shaped, micron-sized pores and the wall structure of dendritically ordered copper nanoparticles.

6. The method according to claim 3, wherein the surface layer is deposited by a controlled gas phase deposition process generating gas bubbles that define the macro-pores, thereby depositing the material on the substrate to form the surface layer with both regularly spaced and shaped, micron-sized pores and the wall structure of dendritically ordered copper nanoparticles.

* * * * *